US005516233A

United States Patent [19]

Courtney

[11] Patent Number: 5,516,233

[45] Date of Patent: May 14, 1996

[54] WATER SAFETY AND SURVIVAL SYSTEM

[76] Inventor: William L. Courtney, 1990 Highway One, Elk, Calif. 95432

[21] Appl. No.: 149,137

[22] Filed: Nov. 8, 1993

Related U.S. Application Data

[63] Continuation of Ser. No. 870,244, Apr. 17, 1992, abandoned.

[51] Int. Cl.[6] ..... B63C 11/02

[52] U.S. Cl. ..... 405/186; 441/40; 441/92; 441/106

[58] Field of Search ..... 405/185, 186; 441/40, 80, 88, 92, 96, 106, 114, 115

[56] References Cited

U.S. PATENT DOCUMENTS

| | | | |
|---|---|---|---|
| 3,179,963 | 4/1965 | Peterson | 441/115 |
| 3,877,098 | 4/1975 | Braly | 405/186 |
| 3,967,459 | 7/1976 | Denis | 405/186 |
| 4,016,616 | 4/1977 | Walters | 405/186 |
| 4,560,356 | 12/1985 | Burr | 441/88 X |
| 4,645,465 | 2/1987 | Courtney | 405/186 X |
| 4,681,552 | 7/1987 | Courtney | 441/115 X |
| 4,779,554 | 10/1988 | Courtney | 405/186 X |

*Primary Examiner*—David H. Corbin

[57] ABSTRACT

A water safety and survival system that provides a multi-chambered personal flotation device that operates on minimal volume to create a single heads up righting moment that reliably stabilizes an unconscious victim with his airway out of the water. This is accomplished with a minimal amount of lift, less deflated bulk, improved cosmetic appeal and reduced cost. These combined advances result in a safety vest conducive to actually being worn, a key feature for a safety vest. The system also provides for incorporation of a separating second inflatable life ring, rescue board, artificial respiration assist platform and ultimately a raft for removal of the victim from the water to protect him from hypothermia. This sequentially inflated, multi-chambered, multi-faceted inflatable rescue product is incorporated within the body of the safety vest. The incorporation of a wide range of rescue products into the body of the personal flotation device will reduce the incidence of that dual tragedy that occurs when the rescuer becomes the second victim. This water survival system when adapted to the special needs of the scuba diver requires the incorporation of a tank compensating keel to offset the deleterious effects of a buoyant empty tank whose buoyancy can force the divers airway under the water. Further adaptation for use underwater also includes a system to adjust the volume of the primary buoyancy compensation chamber and variable valve for segregation and reliable regulation of one or more additional surface flotation chambers underwater. The design of the separating chambers coincides with responsibilities and goals of the diver. These and more modifications for the safe underwater use of the heads up safety vest are critical in order to mitigate the risk of rapid ascent and its consequences, arterial gas embolism and decompression sickness.

19 Claims, 6 Drawing Sheets

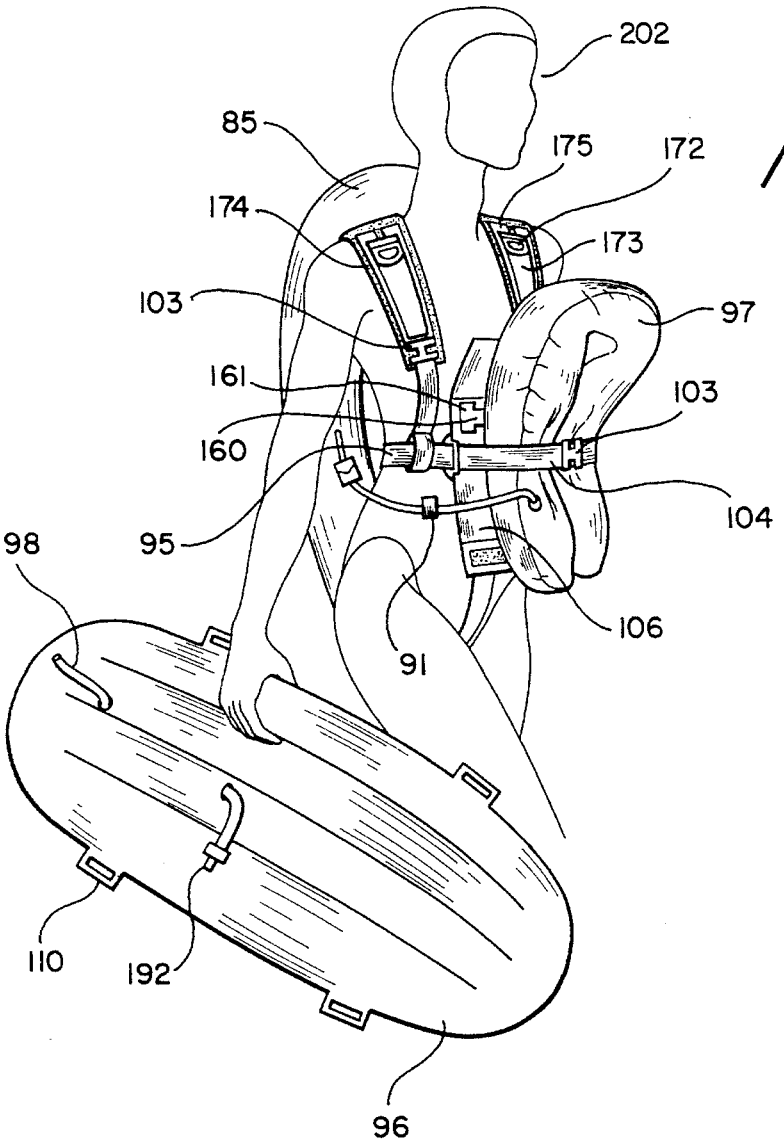
FIG. 10
FIG. 11
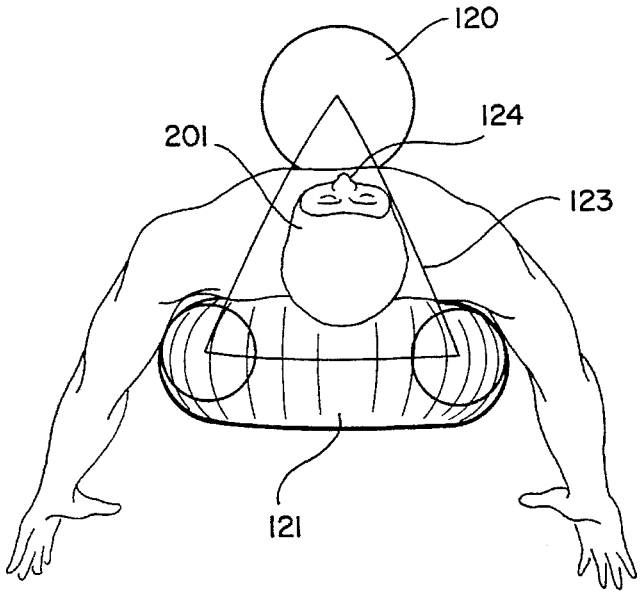

WATER SAFETY AND SURVIVAL SYSTEM

This application is a continuation of application Ser. No. 07/870,244, filed Apr. 17, 1992, now abandoned.

FIELD OF THE INVENTION

This present invention relates to water safety gear including life vests, integrated rescue products and hypothermic protective gear, adapted for one time use by the victim placed in the water by accident or for regular use by the water enthusiast whether a sailor of scuba diver.

BACKGROUND OF THE INVENTION

Heretofore, accidental immersion often resulted in death by two causes, aspiration leading to asphyxiation or hypothermia. A life saving system to be viable for more than a few minutes must successfully address both of these issues. Current life vests supply the requisite amount of buoyancy to return the victim to the surface but often require a conscious victims involvement to keep the airway clear. While it is common practice as well as legally mandated that all civilian, commercial and non-civilian vessels carry coast guard approved life vests, many current water safety products provide only a limited portion of the safety they are capable of providing. They do provide for positive buoyancy during the shock of the initial entry into the water but by incorporation of the concepts disclosed herein are capable of providing significantly improved airway protection after the initial insult with less bulk, cost and consequently more compliance.

By force of habit life vests are currently designed after clothing and as such they open in the middle of the chest producing a point of reduced buoyancy where it is least acceptable. The division of the forward chamber into two halves produces two side chambers which are each capable of generating righting moments in the water. When a righting moment is created on the body of an exhausted or unconscious individual, they can be stabilized in a face down or side down position. If the left or right side is out of the water, concurrent loss of muscle tone in the neck allows the face, nose and mouth to be positioned underwater. Thus current constructions of many life vests are really only adequate for conscious, alert, and active victims because they require participation, constant monitoring and adjustment by the user to keep the face and airway out of the water.

On sudden entry into the water, water on the face actuates the Dive Reflex, which is a rapid uncontrollable inhalation. This reflex often results in aspirating water with its consequent choking and coughing. This distress further complicates the victims ability to right themselves and assist in their own rescue. It is often the case that the sailor who is knocked overboard by the boom of the sail or is swept overboard by a wave, can suffer a temporary loss of consciousness. During this initial interval it is important that their life vest not only buoy them to the surface but that it also obtain and maintain the victims face and airway out of the water until consciousness is regained.

The only life vest that is of any value is the life vest that is worn. Compliance can not be ignored as an important criteria in the design and manufacture of any safety product. The actual use of safety vests has begun to move forward by the hybrid personal flotation devices. The HPFD is a combination of a certain amount of inherently buoyant material along with an additional amount of inflatable buoyancy. Because of the reduced amount of bulk and therefore increased convenience associated with the HPFD, their acceptance is growing. U.S. Pat. No. 4,681,552 issued Jul. 21, 1987 to William Courtney, the current inventor, addresses the value of hybrid personal flotation devices. Like many vest style safety products and in particular all buoyancy compensators, the BC vest described in U.S. Pat. No. 4,681,552, when both chambers are inflated in the configuration disclosed in FIG. 1, would stabilize the user on their side, placing their airway underwater if the user was unable to hold their head up.

The vest that is constructed entirely from inflatable chambers and therefore devoid of the inherent buoyancy requirements of the HPFD, is much more comfortable, convenient and therefore is frequently worn by itself. The purely inflatable product such as the inflatable sailing harness, wind breaker, safety device, because of its compactness, is often the actual product worn by the victim while the coast guard approved device is stowed below decks to satisfy governmental regulations. Many purely inflatable safety products attempt to compensate for the lack of inherent buoyancy by generating large amounts of lift. The use of excess lift often results in the use of air under the arms where it creates the side up righting moment that can jeopardize the airway.

The airlines because of their insoluble stowage problems are allowed the use of a purely inflatable device that has redundant chambers to guard against the failure problems inherent in single chamber safety devices. The scuba diver also wears a purely inflatable device known as a buoyancy compensator or "BC", which looks like a traditional life vest but because it lacks the inherent buoyancy is not called such. The sailor is known to use inflatable wind breakers. All these devices as well as many not described here, that are meant to provide surface flotation to individuals in the water, would be markedly improved by incorporation of the concepts described herein. Whether constructed solely from inherently buoyant means as are traditional life vests, or constructed from a hybrid composition of inherently buoyant and partially inflatable, or constructed from purely inflatable components, the specific location of a minimal amount of buoyancy in accordance with the construction herein disclosed would confer dramatic improvements in bulk, cost and compliance and consequently, in safety and survival statistics at sea.

The prior art on the use of dual chambered safety vests includes Swedish patent #20359 issued to Lindqvist on April 1966. This patent discloses a dual chambered product with a large forward chamber which would allow the victim to be stabilized in either a heads up position or if unconscious the victim could be stabilized lying over the forward float with their nose and mouth underwater. The device also relies on a the victims legs to apply tension to a draw string to pull the rear chamber up behind the victims neck. For the active participant the product may have some utility but would be unsuccessful if not closely regulated. In addition the product is needlessly large and thus unnecessarily bulky when deflated, a feature that often results in the product being stored in a locker rather than being worn.

The buoyancy compensator is a convenience product that has unfortunately replaced the divers safety vest. The BC is a specific adaptation of a purely inflatable safety product that is worn by the diver for use both at the surface and underwater. The product evolved from the orally inflated safety vest that had the appearance of and was often called a horse collar vest. After decades of diving it was decided that the diver would benefit from the inclusion of a chamber to hold air while under water to offset the loss of buoyancy that occurs as the divers thermal protective gear is compressed at depth. The initial compensators for this shift in buoyancy were containers that could be filled with air to displace water and therefore generate increased buoyancy as the divers' wet suit was compressed by the water. In an emergency this device could be easily disconnected from the diver.

The next step in the evolution of the BC was to use the air cylinder to inflate the safety vest, a product designed to protect the airway at the surface. Its proximity to the face and neck, its obstruction of the chest and therefore the site of controls for the dry suit diver, its general bulk and appearance left room for the advent of the life vest style BC. The initial detached, canister BC's were of low volume and easy to ditch. The horse collar and then the life vest style BC became voluminous. The larger lift capacity became equivalent to the better the product. BC's are available with 80 lb lift capacities. At the surface the high lift product conferred a sense of security because it would buoy the diver far above the water as long as diver remained in firm control of the product. As the diving population became more diverse in health and age, the false sense of security led to marked competitiveness over the amount of lift that could be attached to the diver. The product is so confused with security that a diver can not get onto a dive boat without wearing a high lift BC for "safety" reasons.

The inflatable products worn by scuba divers as disclosed in Greenwoods U.S. Pat. No. 3,436,777 issued April 1969, or Roberts U.S. Pat. No. 3,747,140 issued July 1973, or Walters' U.S. Pat. No. 4,016,616 issued April 1977, or Wright III's U.S. Pat. No. 4,137,585 issued February 1979, or Scott's U.S. Pat. No. 4,176,418 issued December 1979 or Maness's U.S. Pat. No. 4,324,234 issued April 1982 or the inventors own U.S. Pat. No. 4,645,465 issued February 1987 and U.S. Pat. No. 4,681,552 issued July 1987, all buoyancy compensators in the prior art are complicated by the attachment of an air cylinder that undergoes shifts in buoyancy throughout each dive as the cylinder empties and becomes more buoyant. The size of the shift in buoyancy is directly proportional to the size of the cylinder used. The nature of the shift in buoyancy, whether the cylinder ends up positively buoyant or only less negative, is a combination of cylinder composition, most commonly aluminum or steel and the water density, fresh, brackish or salt. Some air cylinders become six pounds positively buoyant when empty in sea water. This cylinder will float on its longitudinal axis as will the diver who is attached to that cylinder. Consequently, if for any reason the diver is unconscious, such as from a minor embolism from rapid ascent, blackout, trauma, medical problem or just over exhausted after being stranded at sea, they will eventually lie along side the air cylinder with their airway under the water and statistically the deaths are recorded as drowning. The current management of the life threatening side righting moments of every vest style buoyancy compensator is to disclaim liability for keeping the airway out of the water.

This invention discloses the integration of a very small amount of non-releasable weight exactly opposite the diver that converts the only inflatable worn by divers into a product that will protect the airway if the diver is unable to. The attachment of weight to the air cylinder in the prior art has been a way for carrying the ballast necessary for the diver to be able to submerge, and thus were designed to carry significant amounts of weight. Patents issued have turned on the design of the release system. The dive community demands that the attachment of significant amounts of weight must be able to be quickly released by one hand, by either hand. The release mechanism must be sure in that it must not accidentally release, but once the diver chooses to release the ballast the mechanism must be simple enough that it will not fail. All of the prior art by way of its incorporation of reliable release mechanisms assures the diver that as an emergency is evolving and their weights are dropped to gain a better surface attitude, the air cylinder that was critical for use under water and is now empty will be attempting to float the diver on their side. If the diver is unable to oppose this action, their nose and mouth will be forcefully submerged.

It is to be noted that in U.S. Pat. No. 4,455,718, the quick release means is positioned centrally to allow access by either hand in the event of an emergency release. Prior to the release, the central positioning of the quick release mechanism necessitates that the weights as demonstrated in FIGS. 1 and 2 and be placed off center, potentially reenforcing the side righting moments of the life vest style BC. The keel retaining system disclosed is built into the BC so it will not be lost or left at home, the BC cannot be safely used without this critical component. In U.S. Pat. No. 3,670,509 it is noted that the ballast is located in front of the tank, close to the back of the diver and consequently closer to the axis of rotation which parallels the spine of the diver, thereby drastically reducing the rotational energy generated per unit of keel weight. This greatly reduces the effective strength of the angular rotation generate by a particular amount of ballast. Since some divers in the tropics may dive with only few pounds of weight, it is important that the keel be kept as far away from the axis of rotation as is possible to maximize the strength of the righting moment. The critical location is on the exact opposite side of the tank from the diver. U.S. Pat. No. 3,670,509 refers to "substantial reducing" the tendency to force the diver face into the water. Use of the disclosed improvements will not allow the face to remain underwater. The ballast in U.S. Pat. No. 3,670,509 that attempts to reduce the face down righting moment, positions the diver so that they are able to ". . . activate the weight release mechanism.", with the loss of the ballast the diver then would be back to floating on their side with their airway underwater. U.S. Pat. No. 3,967,459 locates the weight system inferior and adjacent to the diver nearly the exact opposite as disclosed herein. It is also noted that the this weight system is intended to be released in an emergency reestablishing the tendency of the cylinder to submerge the divers airway. The integrated ballast system of U.S. Pat. No. 4,752,263 is similar in that it is releasible, and located inferior and adjacent to the diver allowing for an airway endangering surface position. The ballast system disclosed in U.S. Pat. No. 2,120,420 places weight symmetrically about the diver which would total eliminate any heads up righting moment and in fact would stabilize the diver 50% of the time in a face down position, additionally, this system is not designed to be used with an air cylinder, rather surface supply air. It is critical that the weight be permanently attached, so that in an emergency it cannot be dropped. Since the keel weight must be small enough to not compromise surface safety, it must be located on the cylinder exactly opposite the diver where it generates the maximal rotational energy per pound of keel, rotational energy desperately needed to repeatedly turn the unconscious diver over onto their back against minor righting moments caused by limbs, variations in body density, and attached gear. In particularly, if the victim dives near heavy surf where the waves can flip a victim over onto their face, a strong heads up righting moment is essential.

Another critical problem with the use of all current buoyancy compensators is that they combine high lift surface flotation needs with low lift underwater buoyancy needs. That same device at depth entraps pressurized air by design. The 190 lb diver at 120 feet underwater requires nine pounds of air in their buoyancy compensator due to compression of their cold water wet suit, should that diver begin an uncontrolled ascent because; their regulator malfunctions, their tank is empty, they loose their mask and become disoriented, the power inflator sticks on their buoyancy compensator, they suffer a minor medical problem as they attempt an emergency assent, for whatever the reason, as the diver ascends, the air in their BC begins to expand. Ten pounds of air at 99 feet underwater, increases to 13.3 pounds at 66 feet and increases to twenty pounds at 33 feet and doubles forty pounds during the last 33 feet of the water column, enough air to create excessively fast ascent rates.

Recommended safe ascent rates are in the process of being reduced from 60 feet per minute to 40 feet per minute. A BC that can contain 30 lbs of air can accelerate a diver who is stationary less than 10 feet underwater to the surface at average velocities over the last 4 feet, in excess of 200 to 250 feet per minute. Ascent rates from greater depths or ascent rates with larger BC's such as currently available products generating 40, 60 or 80 lbs of lift are unknown. It is known that if a persons lungs are fully inflated and they hold their breath while ascending three feet, their lungs will rupture. Pulmonary barotrauma introduces air into the circulation where it can obstruct circulation and result in infarction of the tissue involved. Since the diver is often vertical during an uncontrolled rapid ascent, the embolism most often travels to the brain. Unless the diver is recompressed within minutes damage is permanent and possibly fatal. The prior art on buoyancy compensators, as is practiced in the diving community, unfortunately combines low lift buoyancy compensation needs with high lift surface flotation. The prior art buoyancy compensator is in desperate need of the many advances disclosed herein.

Once the conscious or unconscious individual is supported safely at the surface with their airway free and clear, the next major threat to the water borne victim whether recently returned from the depths or a survivor of a common carrier accident such as an airplane crash, is from; not being seen by search and rescue efforts, of being drowned while attempting a rescue or from hypothermia.

The rapid lowering of the bodies core temperature results in interruption of life sustaining cognitive activities such as staying in a tucked fetal position, further aggravating heat loss. With the loss of cognition the victim stops monitoring and responding to changing surface conditions. Inevitably hypothermia interferes in brain stem activities such as musculoskeletal tone and respiration. It is widely known that hypothermia is the actual killer in most accidental immersions. In response to such knowledge, exposure suits have been developed to insulate individuals and preserve core temperature thus extending survival from minutes to hours. An effective exposure suit is a large, bulky item that is prohibitively expensive. Despite these serious drawbacks it is the only alternative to dying from hypothermia within minutes and as such it is a legally mandated safety device for the industrial sector where its costs, bulk and inconveniences can be borne. Exposure suit costs and bulk have prevented their use being required in the recreational, civilian or commercial carrier sectors such as airlines, liners, ferries etc. Therefore it is clear that despite recognition that hypothermia is the active process in death at sea, there has not existed until this time a viable, affordable, storable means to control hypothermia.

To address this deficiency in the prior art, the current invention addresses both aspects of safety at sea. Rescue can rarely be performed within minutes. Often the sailor on watch is not missed until the next watch, obviously the single handed sailor is never missed. The sinking of a civilian or commercial carrier is often unattended for many hours or longer. As is noted in Harrigan's U.S. Pat. No. 2,114,301 dated July 1936, or Bennett's U.S. Pat. No. 3,105,981 dated October 1963, or De Simone's U.S. Pat. No. 4,187,570 dated February 1980, there exists complex, bulky and costly means whereby jet pilots and navy personnel have personal power inflated life rafts. These automatically inflated life rafts require a cylinder whose cost alone is prohibitive to private and commercial carriers. The bulk of the cylinder, the bulk of the raft constructed from a fabric capable of withstanding pressurized inflation and high impact forces results in a device that is incompatible with civilian and commercial carriers such as airlines or ferries, yet alone individuals wind surfacing, fishing from rubber rafts or touring in ocean kayaks.

OBJECTS AND ADVANTAGES

The smallest safety vest that reliably protects the victims airway is ideal because of its lower cost, reduced bulk when deflated, and improved appearance, all factors that contribute to compliance with use, the true basis of success in any emergency. The current water safety vest distinguishes the two critical points of buoyancy, one behind the neck and head with the second point of buoyancy being in the area of the umbilicus. A very small amount of buoyancy securely attached to the victim at these two points is sufficient to roll an individual over and put them on their back, there by protecting their airway from submersion. Entry and adjustments are from below, from the side or if from the front then the front chamber must overlap and be maintained and secured in a central position. Only this combination of small buoyant chambers reliably creates safe positioning of the victims neck and head. This face up righting moment is generated regardless of the angle of entry into the water or level of conscious participation. This strong righting moment also compensates for the ongoing effects of rotational forces such as waves that at a certain point will over come the lateral stabilization provided by the rear perimeter chamber.

Ideally the rear chamber is constructed to cradle the head and neck preventing it from drooping over backwards and becoming submerged. The chamber can be extended along the sides where they act much as outriggers, stabilizing the body from being rolled over because of wave action. The perimeter rear buoyant chamber defines a space, and actually forms a containment means for stowing a separating flotation chamber, such as multi-function rescue safety product to be described more fully hereinafter. It also is the ideal site of expansion that occurs when an inflatable life vest is actually inflated. All inflatable buoyant chambers upon inflation convert from a two dimensional product to a space occupying three dimensional object. This creates a shortening that results in constriction. Power inflated vests generally have an over pressure valve to protect against rupture but before this is actuated an unacceptable amount of pressure is applied to the thorax of the wearer. To compensate for this either the garment is very loose so that when it is inflated the wearer can still breathe or the chamber slides along a retaining strap or belt shifting the position of the inflatable bladder and thereby shifting the righting moment. Current inflatable vests upon inflation slide to the rear as an accommodation to the front entry. This pulls the buoyant means towards the back and results in greater moments of stability in the side high position which submerges the airway. In the current embodiment if the vest is entered from the front its closure is fixed. The rear buoyant chamber upon inflation stretches away from the center of the back and out towards the sides strengthening the lateral stability of the vest and the forward central buoyant bubble remains aligned along the center.

There are several reasons that most life jackets are vest style; the historical basis of clothing design, the need to locate the required amount of lift required by the regulatory agencies and the degree of fit. The buoyancy generated by the life vest must be able to be secured reliable about the torso of the wearer. Entry into the water or rough surface action must not strip the life jacket from the victim, in this regard the secure closure, appropriate sizing and an elastic component combine to provide a reasonable attachment. The only way to be assured that the victim and their life jacket will not be separated is by the inclusion of a crotch strap. Once again compliance is a function of comfort. If the crotch strap is loosely attached prior to entry into the water, then easily adjustable while in the water, it might be used. A wet, limp, unconscious victim being tossed about by waves will require a retaining strap between the legs to optimize the survival value of any buoyant product attached to the victim. Its inclusion in a life saving system is necessary, the option of its timely use is a function of comfort and cosmetics. Another reason the current vest design of water safety products if that the coast guard requires certain amounts of buoyant lift for varying classes. Commercial requirements exceed those for personal use, but all classes displace such a large volume of water that the buoyant means needs to be spread out over a large surface area such as is provided by a vest style life jacket configuration, despite its serious drawbacks.

Some vest style life jackets have four righting moments; face up, back up, left side up and right side up. The current invention creates a broad base triangle. Central to this inventions uniqueness is a small buoyant bubble that is centrally located in front of the wearer. The front chamber is responsible for initiating the righting moment, and supplies the rotational energy needed to roll the victim over onto their back thereby assuring that the victims face will be out of the water regardless of the angle of entry. Once the forward chamber has reached the surface, it in conjunction with the dynamics of a limp unconscious body, will oppose any tendency for the waves to roll the victim over into a face down position that would compromise the airway. If the front chamber is to wide, it can combine with the rear buoyant bladder and create a second, life threatening righting moment in which either side could be held at the surface and concomitantly the airway submerged. In summary, the rear buoyant chamber provides a base of support for the head and neck, supporting the airway and providing laterally stabilization, opposing rotational motion of the waves from over turning the victim into a face down position, but in the event that occurs, the forward buoyant bubble that is located at the umbilicus will automatically flip the victim back over onto their back, reestablishing the heads up orientation.

While the forward and rear buoyant chambers could be constructed from a single chamber, ideally two or more chambers confer several advantages. In this design one of chambers is retained by a releasible system. This feature allows the wearer the option of being able to remove a chamber and use it as a distress marker, thus the preferred embodiment is to construct the forward chamber from a highly visible and radar reflective material. Separation also allows the chamber to be used as a rescue device. It can function as a rescue board to approach a swimmer in distress or used as a buoyant assist beneath the arms of the rescuer to provide lift in the event the rescuer is attempting to perform artificial respiration while in the water.

In adapting the product for the scuba diver, the separating chamber can be used under water by the advanced diver to mark a dive site such as in search and rescue attempts. The separating bladder can also be used as an underwater lift or salvage device rather than the common but unsafe practice of using the divers high lift BC as a salvage device. In the event that the object being salvaged slips from the divers grasp, the diver suddenly becomes markedly buoyant and is thrown into an uncontrolled ascent. In the event of a sudden increase in boat activity the diver could leave the separating chamber at the surface marking the dive site, so that boaters will avoid driving over the partially submerged diver. The universal retaining strap of the releasible chamber ideally has an elastic component,to allow for distention of the bladder when it is inflated. The separating chamber when modified for use underwater in a buoyancy compensator must be reliably regulated. Safe and secure containment of the bladder underwater is critical. As helpful as additional buoyancy is at the surface, that same buoyancy underwater represents serious exposure to rapid ascent with its numerous serious problems. On the other hand the surface flotation chamber must also be simply and quickly deployed to be of assistance for an emergency at the surface.

Because the volume of the BC has been reduced to mitigate the chances of rapid ascent, it is foreseeable that the forward surface flotation chamber may not be deployed in an acute emergency underwater so the rear chamber and the disclosed keel weight have to be sufficient to protect the airway by establishing a heads up orientation with or without the deployment of the forward chamber.

When an air cylinder is attached to the heads up life vest, the tank compensating keel becomes critical. It is called a keel, because when the diver is lying face down at the surface and goes limp, the tank compensating keel, like the keel of the sail boat will roll the diver over onto their back, stabilizing the airway out of the water. The compensating portion of the name is because the size of the weight is in proportion to the type and size of the cylinder and whether the water is fresh or salt. If the cylinder when empty is neutral to slightly negative it will sink allowing the diver to roll over onto their back. The keel in other words compensates for the buoyancy shifts of the divers air cylinder. If the cylinder remains negative when empty then the keel can be smaller but still must generate sufficient angular momentum to offset the secondary righting moments generated by an imbalanced weight belt and attached gear or bladders. If the keel is used as an adaptation to existing vest style BC, then it has to be strong enough to overcome the side righting movements generated by the common practice of using buoyancy under the arms.

Central to the tank compensating keels design is that it be made of a very dense material such as lead, and be located exactly opposite the diver on the back side of the tank. Traditionally the buckle that generates pressure on the belt that attaches the buoyancy compensator to the tank is located in the center at the back of the tank. Because the posterior central position is so critical for the performance of the keel, the buckle has to be moved off center. This shift in the cam buckles location results in a slight inconvenience in terms of reduced access but is necessary to preserve the critical location and therefore the righting moment of the compensating keel.

Drowned divers are often found with their weight belts still on. Usually the weights are located along the waist and the amount runs from a couple of pounds to more than forty pounds. As the amount of weight increases, the keel needs to be located higher up the air cylinder to offset the placement of the weight belt. The dual tank band allows for a wide variation of weight placement. Obviously the keel could be incorporated into the metal of the cylinder, adhered to the cylinder, enclosed in a covering of any sort, or even attached with magnetism. A pouch or cylinder could be used to contain lead shot or beach sand as long as it is located along the longitudinal axis of the cylinder and thereby serves to generate the heads up righting moment.

Additionally the concept of critical ballast is such that a certain amount of ballast is absolutely required in order for the diver to stay underwater. To facilitate the concept of safe diver weighting the tank compensating keel is also used to offset the inherent buoyant material from which the buoyancy compensator itself is constructed. Thus because of the tank compensating keel, the BC, tank, and regulator combination is neutral and as such does not contribute to the consolidation of additional ballast on the weight belt. If the quick release buckle of a consolidated weight belt should snag on a plant of slip out of hand during adjustment at depth the dangers of an uncontrolled buoyant ascent are somewhat mitigated because the shift in buoyancy is reduced by the amount of ballast used as a tank compensating keel.

While the forward chamber is not critical for protecting the airway of the scuba diver because of the effectiveness of the tank compensating keel, the forward chambers ability to provide additional high lift surface flotation fulfills an expectation in the sport. The key to the addition of high lift surface flotation to the diver underwater is its safe regulation. The operation of the forward chamber requires diametric opposed properties of the valve chosen to regulate the chamber. One embodiment employs the use of a variable fabric valve fabricated from a self releasible hook and loop fastener such as VELCRO® that can operate in three different modes, as a manual on off valve, semi-automatic valve or a fully automatic valve. In addition, as the fabric valve ages its strength can be renewed by further increasing the interactive surface area.

The value of including a variable valve in line between the rear chamber and the forward chambers is that the diver can become more responsible with experience and training for the total amount of lift available to the diver underwater as well as at the surface and thus more responsible for uncontrolled ascent rates and consequently the risk of pulmonary barotrauma, arterial gas embolism and its frequent outcome cerebral infarction as well as the risks of decompression sickness.

Some dive instructors fear that the beginning student will not be able to perform an additional task in an emergency and therefore prefer that the entire buoyancy system automatically inflate choosing simplicity of operation at the expense of exposing the beginning diver to the consequences of a more rapid uncontrolled ascent despite that fact that deaths have occurred during buoyant ascents while in a swimming pool. In particular, since the student will be involved in a lot of surface drills and exercises, such as determining how much weight they require in order to be able to submerge, clearing their masks and snorkels, and since the first dives will be shallow, the consequences of rapid ascent are less severe. As their experience grows and their comfort in the water with their gear and the concepts of correct weighting develop, they will be making deeper dives where the consequences of sudden ascent become progressively more severe. As the student begins to submerge and the lungs become more pressurized the manual operation mode of the valve is necessary for the diver to safely regulate the total amount of lift attached to their body underwater and thereby mitigate one of the major risks of diving.

As the buoyancy compensator is reduced to a device dedicated to contain the small amounts of lift actually required while underwater, some instructors are concerned that the diver will not be able to rely on the BC for a buoyant ascent. The problem with buoyant ascents is that they are very difficult to control when all the divers' faculties are intact. In an emergency the ability to regulate a high lift BC at depth is very unlikely. Ideally one of the forward chambers is a low volume chamber designed for emergency ascent which has incorporated a rupture plug, disc or weld so that if the product is deployed intentionally by use of a CO2 cylinder or the divers air cylinder or accidentally it will self destruct at a preset pressure differential, limiting its buoyant assist to the first leg of an emergency ascent allowing the diver a second chance to regain control and reduce their velocity to a safe rate. Some of the larger high lift surface flotation chambers may never fill to rupture so its containment system that regulates its inflation must be very secure to be assured that it will only be deployed intentionally, otherwise the diver would be in the same high lift rapid ascent predicament that they currently find themselves in with today's product.

Incorporated within the multi-chambered heads up safety vest is a multi-function rescue safety product which can culminate into a raft for removal of the victim from the water and thereby confer protection from hypothermia. The needs and use of this rescue safety product determines its requirements for durability which in turn determines the type of fabric, its storable volume and therefore the location of the rescue product within the safety vest. The primary flotation device or life vest stays secured to the individual to assist them during their entry, support them while they are deploying the rescue product. Once inflated if the product is not needed for rescue or signaling, the rescue product evolves into a raft that the individual can crawl into. The life vest remains on the victim protecting the individual should they be washed over board as well as insulating the trunk, further helping to maintain core temperature.

The need and uses of a rescue device varies with the application. For the civilian airline passenger suddenly thrust into a survival situation, they are provided with a floating cushion or a light weight inflatable life vest. In this situation a single use, ultra lightweight product is ideal. Such a rescue product might be constructed from an all welded mylar film. A multiplicity of layers would confer separate air chambers within the product providing for insulation, conferring puncture protection while remaining small enough to fit inside a seat cushion or within a pocket of a purely inflatable life vest. To facilitate the single use products operation the oral inflator would lead to a manifold which could be constructed of differing diameters and/or which would pass through separate one way check valves of differing relief pressures. The diameter and/or pressure relief valves would direct the flow of air such that the chambers could be inflated sequentially. As pressure in the system builds up after inflating the first air chamber the second begins to inflate. The arrangement would allow for the inflation of a life ring first, followed by the a rescue float, then if necessary a large outer tube would convert the rescue product into a raft with a canopy arch. This mylar in addition to reflecting the radiant energy back towards the victim is mirrored so that it is highly visible and radar reflective both of which would facilitate search and rescue. It structurally would resemble a single use raincoat. With the advantages conferred by this invention the victim could be of assistance to themselves or others. Survival would be increased from minutes to days, dehydration would become the next serious threat to the survivor. An off the shelf plastic solar still could be easily included for trans-oceanic passages.

The water enthusiast on the other hand may find themselves in the water more often than the civilian airline passenger and their needs may tolerate slightly more bulk from the stored rescue product in exchange for reusability. The bulk increases because of the demands of a more durable and reusable product requires a more substantial choice of fabric. As the bulk increases, the location for stowing the rescue product becomes more critical. The ideal location is built into the back of the life vest where it is out of the way but securely and accessibly stowed until needed. In this posterior and inferior position the actions of the new and improved life vest are retained, that is the perimeter of the torso is supported by the rear inflation chamber of the life vest, stabilizing the victim against inadvertent rotation to a face down position. The location of the raft, is ideally within the walls of the life vest, protecting the raft from the shearing forces of entry, freeing the hands to assist entry and recovery once in the water. An envelope for containing the rescue product could be provided so that it could be attached to the inside or outside of any current life vest and thereby confer the protective advantages to all owners of a life vest without having to incur the cost of buying a new life vest. This would allow all current owners of a safety vest to upgrade to a dual chambered separating water survival system. This attachment system employs a hook and loop fastener looped through the arm holes and is universally adaptable to all life vests, of all sizes . Any releasable fastener such as buttons, zippers, snaps, hook and loop etc., would allow for the rescue product and its stowage and release system to be located comfortably centered both up and down as well as side to side. While it could be positioned outside the life vest its inclusion within the life vest will ensure its secure attachment. The inflation of the rescue product is determined by its use, cost, and available stowage space but since oral inflation is not restricted by shelf life, is always present and most affordable. Inflation via a manifold will allow the rescuer to provide a rapidly inflated life ring to help stabilize the victim through the initial insult and then provide a float while the remainder of the chambers are inflated. In the current embodiment the rescue product is built into the safety vest or floating cushion, of anyone in the water intentionally or accidentally and is sequentially inflated through a series of rescue products that culminates in a raft for removal of the individual from the hypothermic effects of the water.

An additional advantage of the disclosed invention is directed to the adaption necessary when the safety vest is used underwater by the scuba diver. In this application the heads up safety vest would be called a buoyancy compensator or BC. Because of the serious consequences of rapid ascent on pressurized lungs, in addition to the reliable regulation of the high lift surface floatation component of the BC, the primary buoyancy compensation bladder should be of variable size. By design the BC is to be used underwater where it is vulnerable to inflation from entrapped pressurized air at two to three atmospheres, as well as subject to inflation from panicked misuse or mechanical failure of the power inflator, all causes leading to the same result, dangerously rapid ascent rates. The volume of the bladder should be tailored to the dive environment. The dedicated buoyancy compensator can be adjusted to the lowest volume needed to accomplish the goal of compensating for compression of thermal protective gear and the resultant loss of buoyancy. As the dive environment changes, so does the need for thermal protective gear. In tropical water minimal or no protective gear is worn and therefore the diver has noting to compress and so experiences no loss of buoyancy at depth. For the diver in a bathing suit, their need for a power inflatable bladder underwater is limited to the shift in buoyancy that occurs in their air cylinders, and usually is well under 5 or 6 pounds of lift. This chamber is real only needed to cover the initial overweighting needed to allow the diver to be neutral at the end of the dive in order to make a safety stop. This product should not be called a buoyancy compensator as a first step in reeducating the diving population about the dangers of power inflatables underwater.

In cold water, at 120 feet of depth, a 190 lb diver in a ¼ inch neoprene wet suit, experiences a loss of 9 lbs of lift due to compression of the wet suit. Most sport divers are smaller and therefore are wearing less neoprene, dive in warmer waters and/or making shallower dives. There is no justification for subjecting a diver to unnecessary risks of rapid ascent. Due to the extreme danger of pulmonary rupture and secondary air embolism that results from a rapid uncontrolled ascent it is imperative that the buoyancy compensation chamber be restricted to the lowest volume absolutely necessary to accomplish its goal. Any lift over and above the minimum amount exposes the diver to unnecessary risk. The diver doing repetitive dives in one day is advised to do their deepest dive of the day first and will need a buoyancy compensation capacity commensurate with their thermal protective gear and dive plan. As the dives become shallower and consequently warmer as well, the volume of an adjustable buoyancy compensator can be reduced, and consequently reduce the divers exposure to the risk of rapid ascent. Recommended ascent rates are dropping from 60 feet per minute to 40 feet per minute. The medical literature notes that a 30 lb BC can produce average velocities in excess of 250 feet per minute from less then ten feet under the water. For several generations, divers dove with out a BC so its use cannot be construed as critical. The advent of this convenience product has resulted in ballistic ascent rates because of the air entrapped inside the product which is pressurized at depth which then doubles and possibly quadruples upon ascent depending on the initial depth. An inexperienced diver in an out of air situation is prone to forget about the intellectual concept of arterial gas embolism in the hypoxic and hypercapnic driven race to the surface, only to die twenty foot from the surface from an arterial gas embolism before ever getting a chance to drown. Drowning is a slow, reversible process that lends itself to rescue for quite some time after the event, unlike arterial gas embolism. When using an adjustable dedicated buoyancy compensator the diver can very precisely control their exposure to the dangers of an emergency ascent through the water column and thereby significantly reduce the risks of rupturing a lung and suffering an arterial gas embolism to the brain or similarly reduced the risks of suffering the bends because of missed decompression stops.

An alternate location for a separating forward surface flotation chamber is for its inclusion within the shoulder straps. The redundant personal flotation device is designed to be separated away from the remainder of the dive gear to provide complete duplication of personal flotation devices in the event of failure of the primary chamber. The chamber can also be used as a rescue and signaling product or snorkeling vest.

Appropriately sized releasable shoulder trim weights offset the operation of the BC underwater, improving swimming position, decreasing frontal area, producing less hydrodynamic resistance and consequently less diver fatigue. Once again, the shoulder trim weight results in a reduction of the consolidated weight welt with its inherent advantage of protecting the diver from accidental loss of all ballast at one time.

In summary a multiple chambered life vest can be of a low volume, low lift, and low profile design as long as at least two points in need of buoyancy are covered, behind the neck and at the umbilicus. Excessive buoyancy can be an extremely detrimental either because the product is not actually worn because it is to bulky or because side righting moments have been created that jeopardize the airway. The separating chamber in the hands of a conscious, capable user can be removed providing a signalling device for facilitating search and rescue efforts or used as a rescue board minimizing the risk associated with attempting to rescue another victim who has become hypoxic. After the initial insult has been survived the user can deploy the incorporated inflatable rescue product that sequentially inflates into a life ring, then rescue board and distress marker and culminates in a raft to remove the victim from the water with its inevitable and often rapid hypothermia. The entire water safety survival system constructed for a single use application could easily fit within the air line seat cushion, dramatically improving survival statistics for accidents at sea.

The multi-chambered heads up safety vest as adapted for the scuba diver, allows for reliable segregation of a variety of high lift surface flotation chambers while underwater. In addition a variable volume dedicated buoyancy compensator allows the diver to further reduce the amount of lift attached to the smallest amount necessary for a particular dive environment. The combination of these two improvements will markedly reduce the largest cause of pulmonary barotrauma, and secondary embolism, a major cause of injury and death in the field of diving. The inclusion of a couple of pounds of weight integrated into the tank band of the Adjustable Buoyancy Compensator will allow the diver to overcome numerous minor righting moments that can place the airway of the exhausted or distressed diver under the water leading to drowning, another major cause of death in the sport of diving. The benefits of the tank compensating keel are so dramatic that they can be included into a separate product that can retro fit existing BC's, converting them into a heads up product. Unfortunately the inclusion of this keel on a high lift BC does nothing to mitigate the rapid ascent rates and consequent embolisms of that product. The inclusion of the multi-function rescue product within the walls of the BC confers on that diver the ability to respond to a number of problems frequently encountered by the diver in rescue, marking and salvage.

BRIEF DESCRIPTION OF THE DRAWINGS

FIG. 10 is a view of the inflatable cummerbund, with releasable forward chamber, carrying an alternatively forward chamber in the form of a float.

FIG. 11 is a view of the pyramidal structure with central forward buoyant chamber and rear buoyant chamber.

DESCRIPTION OF THE PREFERRED EMBODIMENTS

Figure 1:
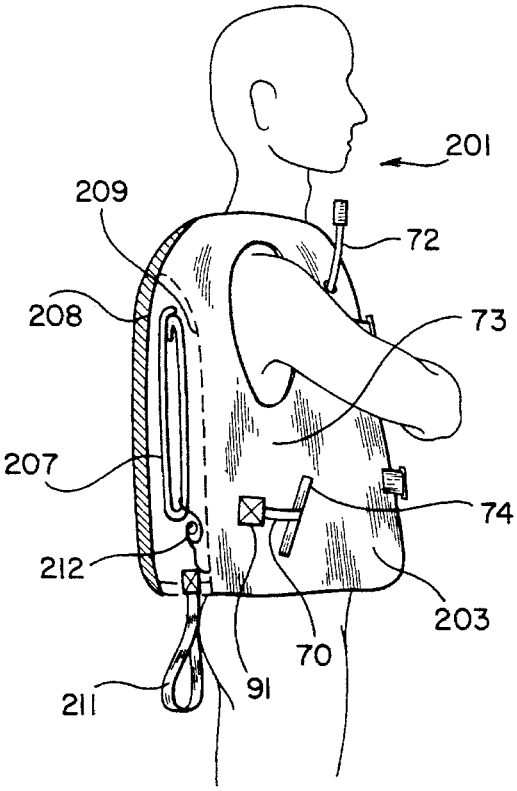
FIG. 1 is a view of a personal flotation device shown incorporating the multi-function rescue product within the back wall of the vest.

FIG. 1 shows victim 201 wearing a vest 203 that can function separately as a snorkeling vest, personal flotation device for boating or alternately hooked up to the primary bladder of a buoyancy compensator through quick release means 91 and hose 70 that is attached within pocket 74. Vest 203 can also be inflated through oral inflation means 72. A multi-function rescue product and raft 207 is stowed within the back pocket of the life vest between the outer wall 208 and inner wall 209. A retrieval strap 211 opens the pouch formed by wall 208 and wall 209, and is wrapped around raft 207 allowing the user to remove rescue product and raft 207, without having to remove vest 203. The outer wall 208 may be comprised of an expansible material allowing inflation chamber portion 73 located along the perimeter of the back to roll forward upon inflation.

Figure 2:
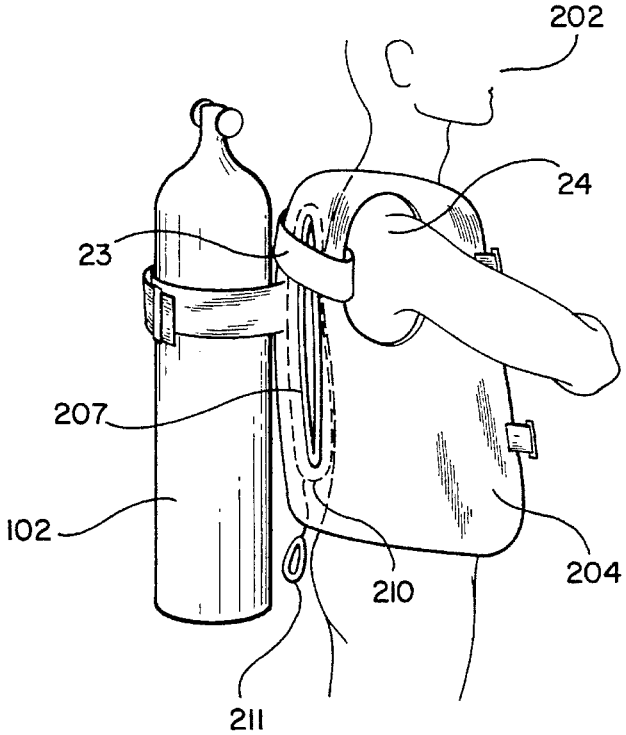
FIG. 2 is a view of an existing buoyancy compensator with the multi-function rescue product attached.

FIG. 2 shows a diver 202 adapting an existing vest style buoyancy compensator 204 to carry the rescue product 207 within a containment pouch 210, held in place by band 23 that is supported by arm holes 24. A retrieval strap 211, is wrapped around rescue product 207, so that it can be removed from the containment pouch 210 without having to remove the vest 204. The scuba tank 102, is standard.

Figure 3:
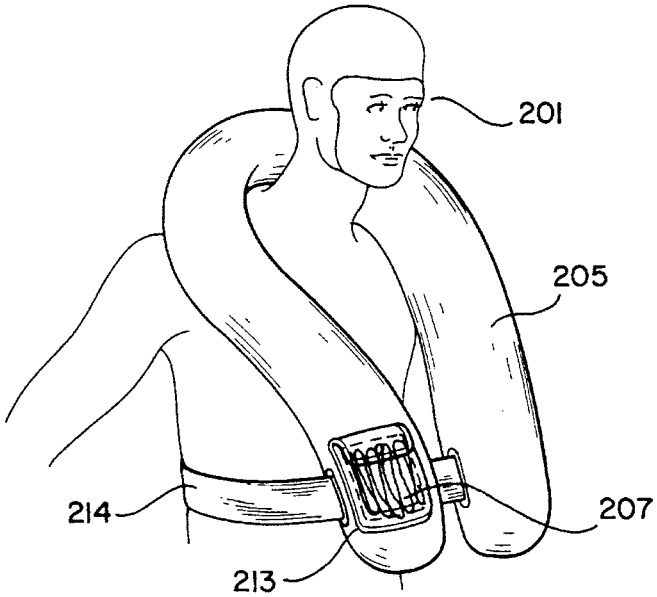
FIG. 3 is a view of a airline life vest carrying a multi-function water rescue safety product.

FIG. 3 shows a typical inflatable vest 205, as might be worn by an airline passenger 201, that is strapped to the victim by strap 214, in the event of a water landing. The typical vest 205, is modified by addition of a containment pocket 213, that stows single use rescue product 207.

Figure 4:
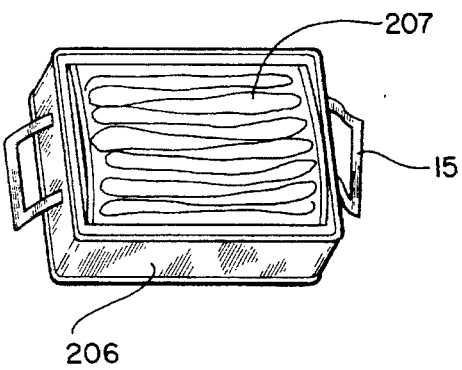
FIG. 4 is a view of an airline seat cushion modified by the inclusion of an ultra light weight disposable multi-function rescue safety product.

FIG. 4 shows an airlines cushion 206 containing rescue product 207. The victim puts their arms through straps 15 to secure the cushion 206 to the victim during water entry.

Figure 5:
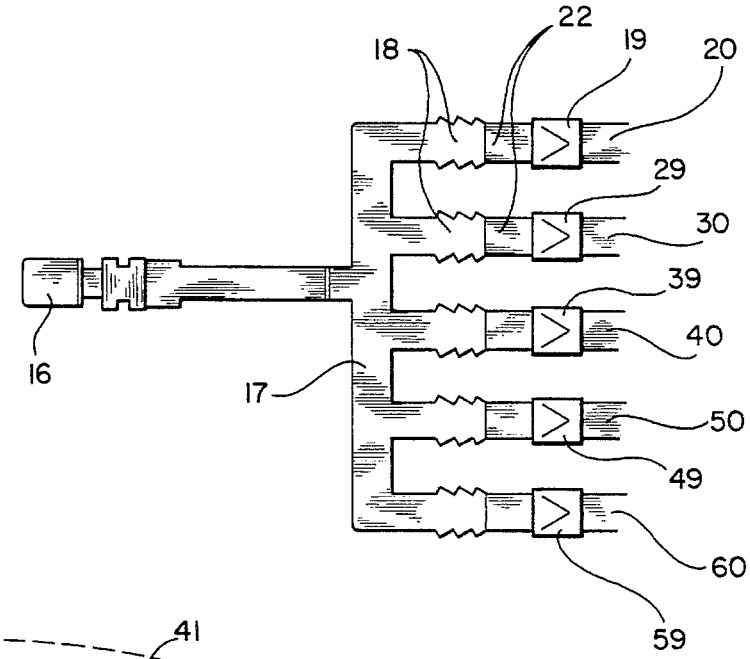
FIG. 5 is a view of a inflation manifold.
Figure 6:
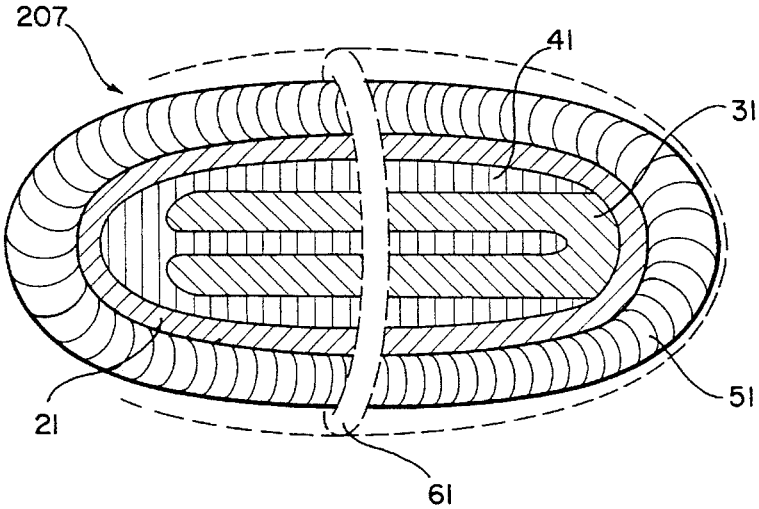
FIG. 6 is a top view of a multi-chambered rescue product.

FIG. 5 shows a manifold device 17, that connects an oral inflator 16, through barbed fittings 18, to a series of one way check valves that can also function as variable pressure relief valves, 19, 29, 39, 49 and 59 that connect via tubing 20, 30, 40, 50 and 60 to a series of inflatable chambers as are demonstrated in the next drawing, FIG. 6.

FIG. 6 shows a multi-function rescue product and raft 207, comprised of life ring 21 which is inflated by tube 20 which because it has the largest diameter tubing and because the pressure relief valve 19 has the lowest relief pressure setting, will inflate first. Inflation chamber 31 or the floor is the second to inflate. Chamber 41 is a second chamber in the floor and because of the setting of the pressure relief valve and or the diameter of tube 40 would be the third chamber to fill. The first three chambers; the life ring 21, and the floor chambers 31 and 41 form a rescue board or distress marker. The next chamber is a wall tube 51 and that can be inflated while resting on combined chambers 21, 31 and 41. The final chamber 61 forms an arch, supporting a protective canopy. In its last configuration the multi-function rescue product 207 can be inflated to a raft constructed from radar, solar and infrared reflective material.

Figure 7:
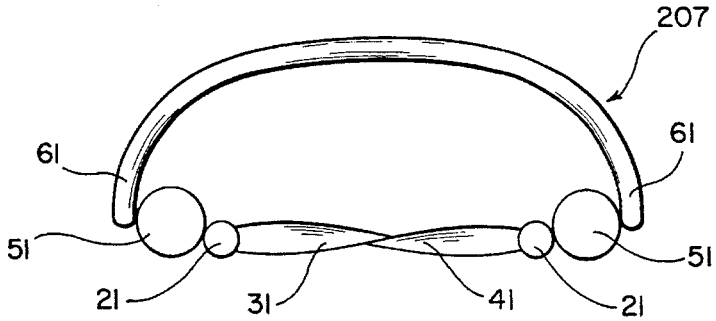
FIG. 7 is a cross section view of the multi-function rescue product fully inflated.

FIG. 7 shows construction of rescue product 207 in cross section, highlighting the various chambers and their sequence in inflation, life ring 21 first, portion of floor 31, remainder of floor 41 second, high volume tube wall 51 third, arch canopy tube 61 last. Ideally the floor is doubled or tripled to provide thermal insulation from the water and puncture resistance.

Figure 8:
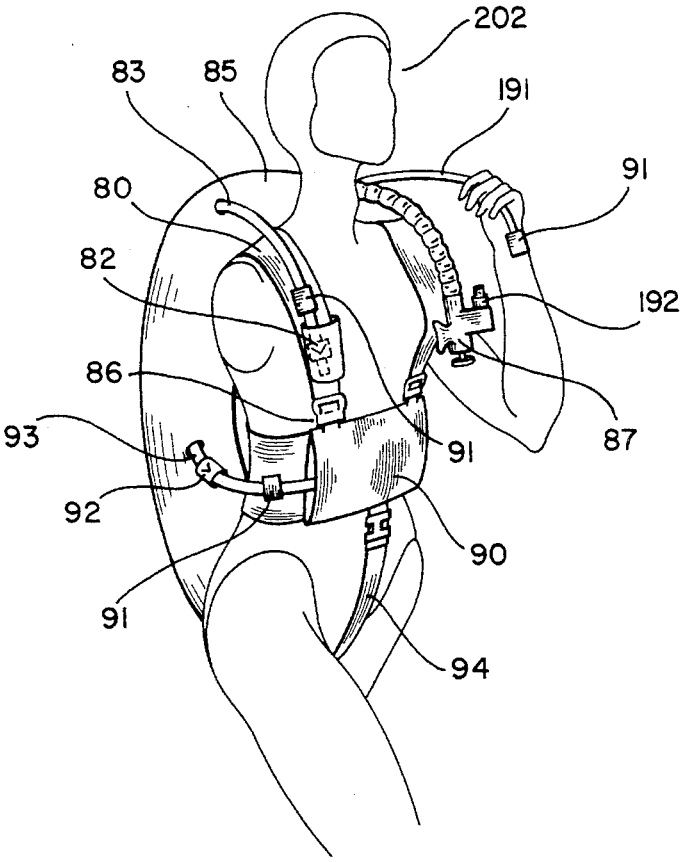
FIG. 8 is a view of a face up personal flotation device modified for scuba diving.
Figure 9:
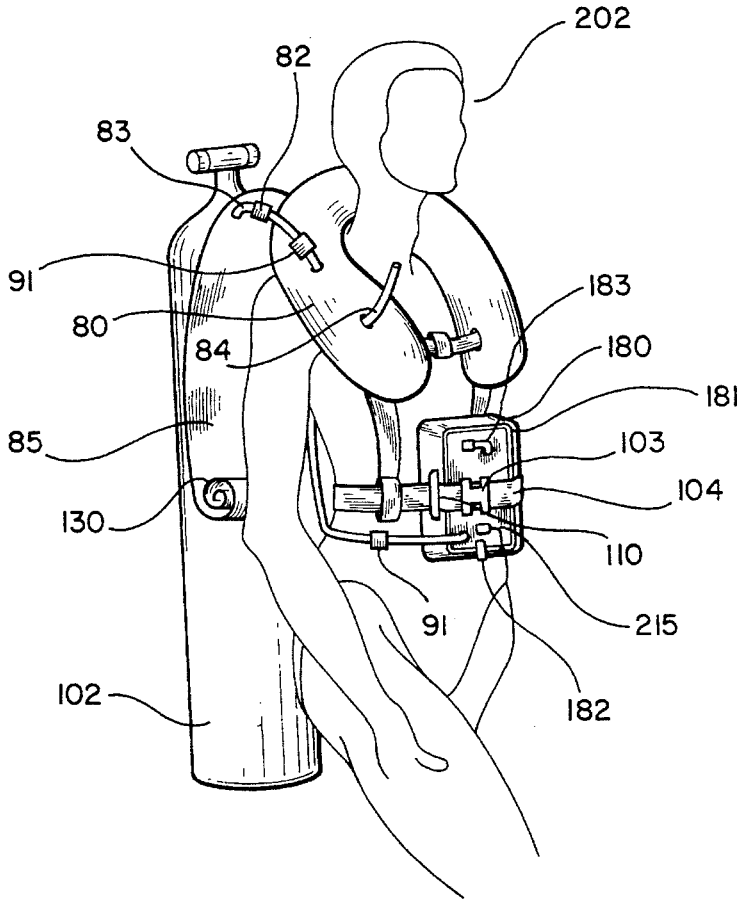
FIG. 9 is a view of the scuba diver with an inflated separating horse collar, and self rupturing emergency ascent chamber.

FIG. 8 scuba diver 202 is shown wearing a heads up multi-chambered dedicated rear mounted adjustable buoyancy compensator having an inflatable chamber 85 connected with hose 83 through quick release coupling 91, and through one way pressure release valve 82 to a releasable inflatable shoulder harness 80 that is stowed in a folded configuration. In FIG. 9 the shoulder harness 80 is inflated. In FIG. 8 an alternate or concurrent surface flotation bladder having an inflatable chamber 90 is connected to buoyancy 85, by tube 93, which is regulated by one way check valve 92, and can be separated from the diver for rescue, salvage or marking activities by quick release coupling 91. In FIG. 8 it is noted that the life vest comprised of inflatable chambers 85 and 90 is snug but releasably attached to diver 202, by a crotch strap 94. The diver 202 in FIG. 8 is holding a 100 psi air hose 191 which couples to the male quick release coupling 192 on the power inflator 87, or can be used to inflate rescue product 207 of FIG. 2, or can be used as a high pressure air source for the rapid inflation of chamber 90 when it is being used in a rescue attempt.

FIG. 9 shows an adjustable buoyancy compensation chamber 85 reduced in volume by rolling up the side chamber as shown at 130. An automatic rupturing emergency ascent chamber 180 is inflated from buoyancy compensation chamber 85 through quick release coupler 91, or by a separate compressed gas cylinder such as a CO2 cylinder 215. Standardized retaining strap 110 secures the emergency ascent chamber to the diver, as found on all the interchangeable forward bladders. Strap 110 keeps bladder 180 from separating from diver 202 until the quick release buckle 103 is opened. Retaining band 104 is expandable allowing for the forward chamber to expand away from the diver upon inflation. In an uncontrolled ascent the diver is unlikely to operate the venting mechanism 183 in which case a rupture plug 182 which crosses a weld line 181 weakening it so that as the chamber 180 pressurizes upon ascent, it will rupture out at the weakened point, thereby reducing total lift attached to diver 202 and helping to control the ascent velocity. In FIG. 10 diver 202 demonstrates two of a wide variety of different releasable forward chambers indicated generally as inflatable means 90 stored in the waist band in FIG. 8.

FIG. 10 shows the diver 202 whose waist band 95 is retaining releasable separating forward chamber 97 which is a redundant horse collar life vest and rescue product. Expansible element 104 stretches upon inflation of the forward chamber 97. In an emergency the horse collar vest 97, can be released from the divers buoyancy compensator by quick release buckle 103. The same quick release buckle is used for releasing the shoulder strap as is standard in the art, and familiar to divers. After releasing the forward vest 97 from the waist, the diver then disconnects the horse collar life vest 97 from its source of power inflation the buoyancy compensator 85, by using the quick release coupling 91. Once the forward chamber has been separated from the rear chamber 85 and diver 202, it can be employed as a rescue board, tied off as a bottom marker, left at the surface to warn boat traffic, or held aloft as a high visibility distress marker. In FIG. 10, the diver 202, is carrying a rescue board, distress marker, surf mat as an alternate separating forward surface flotation chamber indicated as 96. Chamber 96 can be retained by guides 110, on strap 104 of the divers waist band. In FIG. 10, chamber 96 is shown with oral inflation means 98 and quick release coupling means 192 which couples to quick release coupling 91 thereby connected to the rear buoyancy compensator 85, or to the 100 psi air hose from the air cylinder for more rapid inflation. Retaining flap 106 serves to store the releasable forward chamber 97 or 96. Pouch 160 is sealed by flap 161 and is used to contain a small amount of lead shot to offset the buoyancy of the materials used to construct the forward chamber as well as its containment system. On the upper shoulder straps of the diver 202 in FIG. 10, D-ring 172 is attached to hook and loop covering flap 173 that is attached to underlying fabric walls 175 to create a quick release pocket for a lead shot filled pouch 174.

FIG. 11 demonstrates the pyramidal structure of the multiple chambered heads up life vest. The vest is comprised of a rear U-shaped buoyant chamber 121 and the forward centrally located buoyant chamber 120. The triangle 123, formed by chambers 120 and 121 has a single righting moment, face up. The victim 201, and has airway 124 are maintained out of the water whether or not the victim is conscious.

Figure 12:
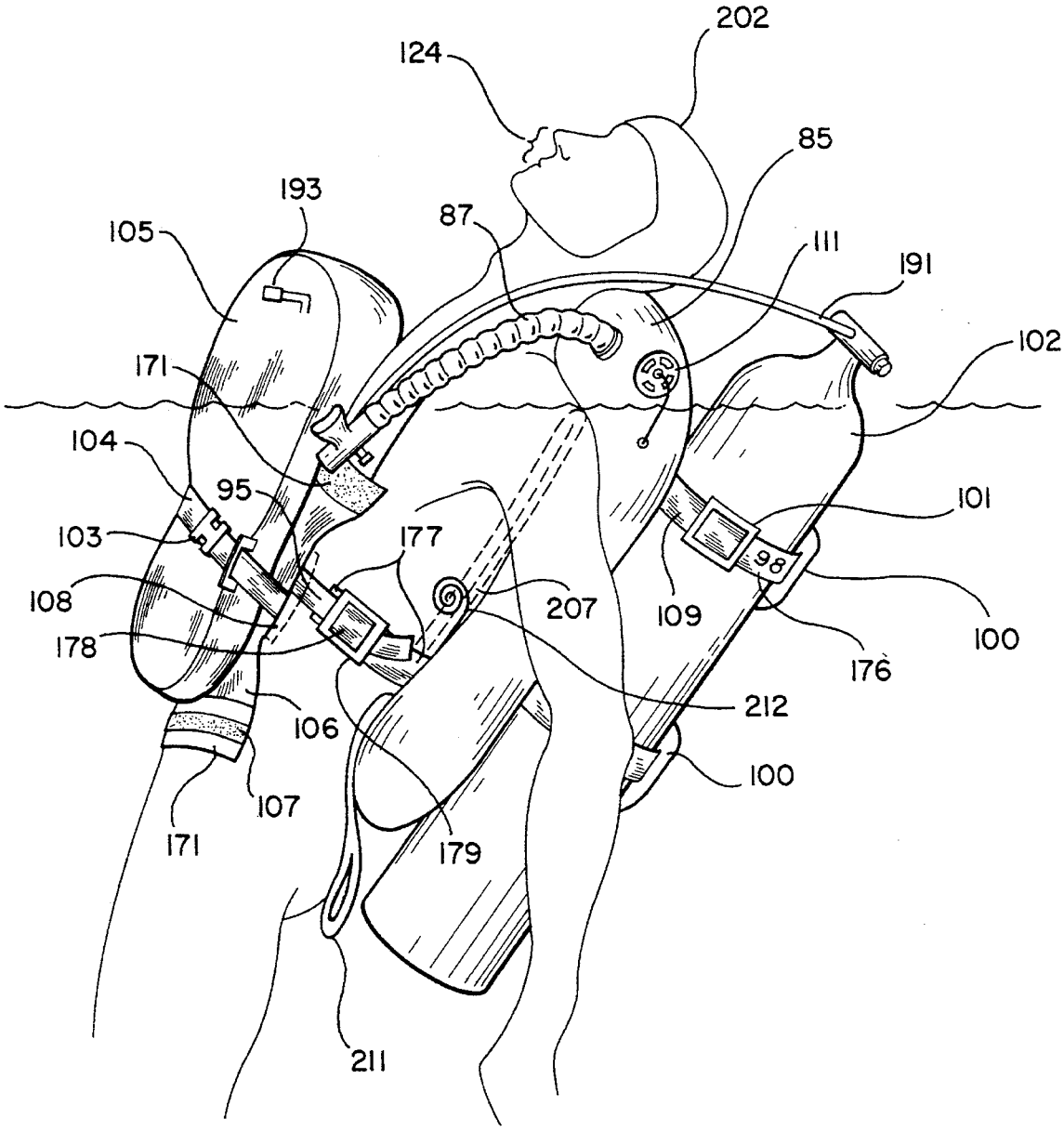
FIG. 12 is a combined view of the elements of the water safety and survival system as it is adapted to the scuba diver.

FIG. 12 shows a composite of the water safety and survival elements disclosed here in. In FIG. 12 the diver 202, is unconscious but his airway 124 is held out of the water. A generic centrally located inflated chamber 105 is retained by expansible strap 104 and could be released by quick release buckle 103 if the diver was alert and it was needed for rescue or for use as a distress marker for search and rescue activities. Waist band 95 is secured in place by buckle 178 which is mounted on a Velcro® base 179 that allows the waist buckle to be adjusted along the length of the left side of the waist band 177 to accommodate the variation in waist size that occurs as different types of thermal protective gear are worn. The buckle 178 is off to the side so that the generic forward flotation chamber 105 retains its critical central location. The forward chamber retaining flap 106 is attached by hook flap 108 to the loop material that covers the entire length of the waist band indicated as strap 95. This allows the forward chamber 105 to be quickly but securely adjusted to its central position. Operation of forward chamber 105 is regulated by the variable fabric valve 171 built into the retaining flap 106. The hook and loop components 171 of flap 106 can be varied by the inclusion of a reducer strip of hook 107. The size of the reducer strip 107 determines whether the flap 106 will open quickly under pressurized inflation from the rear chamber 85, open slowly or not at all. If the entire reducer strip 107 is removed the hook and loop means 171 are of sufficient strength to lock off the forward chamber. An over pressure valve 111, is located on the opposite side of the chamber 85 so that the diver can vary the position of the power inflator from the rear to the front by interchanging the power inflator 87 and over pressure relief valve 111. Rescue product 207 is contained in a pocket built into the rear wall of the buoyancy compensator 85, and is accessible by strap 211. Rescue product 207 is attached to the diver by a releasable lanyard 212. The tank compensating keel 100 is permanently attached to the tank retaining strap 109. Ideally the tank compensating keel 100 is of a hydrodynamic conformation, made from a dense substance such as lead, coated in a soft film such as plastic so it will facilitate keel 100 being securely clamped in place by cam buckle 101. The soft coating will also avoid damaging the protective coating of the tank 102. The tank compensating keel 100 may be replaced by a standard lead weight so that the diver traveling abroad will not have to transport a lead weight. A diver in tropical waters may only require 5 pounds to descend while use of a dry suit in cold water can require 40 lbs or more to be able to submerge, the greater the weight of keel 100, the stronger the face up righting moment it will generate. As the weight belt is increased because of the use of buoyant thermal protection it is critical the keel 100 be increased. Regardless of the size of the keel 100 it is critical that it be located exactly opposite the diver and thus its position must be adjustable so that as the diver changes between diving cylinders of different diameters, keel 100 can be easily adjusted to maintain its critical position. Ideally strap 109 is marked with a scale 176, to guide the diver in selecting the correct placement of keel 100 on cylinders of different diameters. If the keel 100 is slightly off center it could summate with an imbalanced weight belt and stabilize the diver in side up position which will allow the airway 124 to submerge. Because the position of the keel 100, cannot be compromised, the cam buckle 101 is moved to a less accessible position on the side. A waist buckle 178 is attached to a hook fastener base 179 that allows it to be positioned any where along the left side of loop fastener covered waist band 177.

Figure 13:
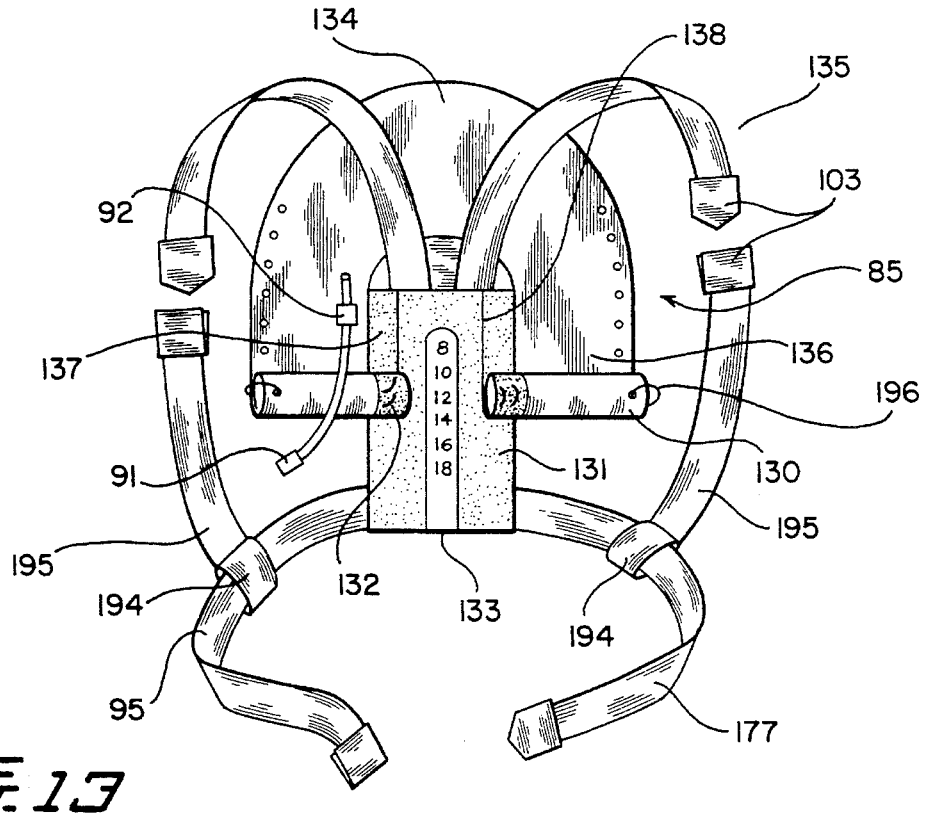
FIG. 13 is a front view of the adjustable buoyancy compensator.

FIG. 13 discloses one of many designs for the construction of an adjustable buoyancy compensator 85 of the type shown in FIG. 9 wherein the portion of the buoyancy chamber that is held inaccessible to inflation is indicated as a rolled up portion of the buoyancy compensation chamber 130. The loop portion of a hook and loop fastener forms the inside back of the buoyancy compensator and is indicated at 131. Loop 131 serves to attach the side chambers 136 by hook strips 132 to the body of the buoyancy compensator 85. Flap 138 is formed from the forward facing loop strip 137 and the rear facing hook strip 132. As the volume of the buoyancy chamber is reduced by rolling up the side chambers, the hook strip 132 adheres to the loop strip 137 to form and secure the roll 130. Clip 196 secures the rolled up grommets to prevent the chamber from unrolling under pressure from the air in the buoyancy compensator 85. The portion of the buoyancy compensator behind the neck is indicated as 134. In the current drawings the side chambers 136 are reduced in an infinitely variable fashion and an indicator 133 informs the diver of the remaining amount of lift provide by the buoyancy compensator 85. The indicator 133, allows the diver to quickly return to preestablished buoyancy compensator lift volumes as indicated for a particular set of dive gear. Quick release shoulder strap buckles 135 rely on quick release buckle 103 and are common in prior art. The lower shoulder straps 195 rely on nylon webbing loop 194 to establish structural integrity and internal hook fastener for positioning webbing loop 194 on the loop fastener covered nylon webbing waist band 95 and 177.

Figure 14:
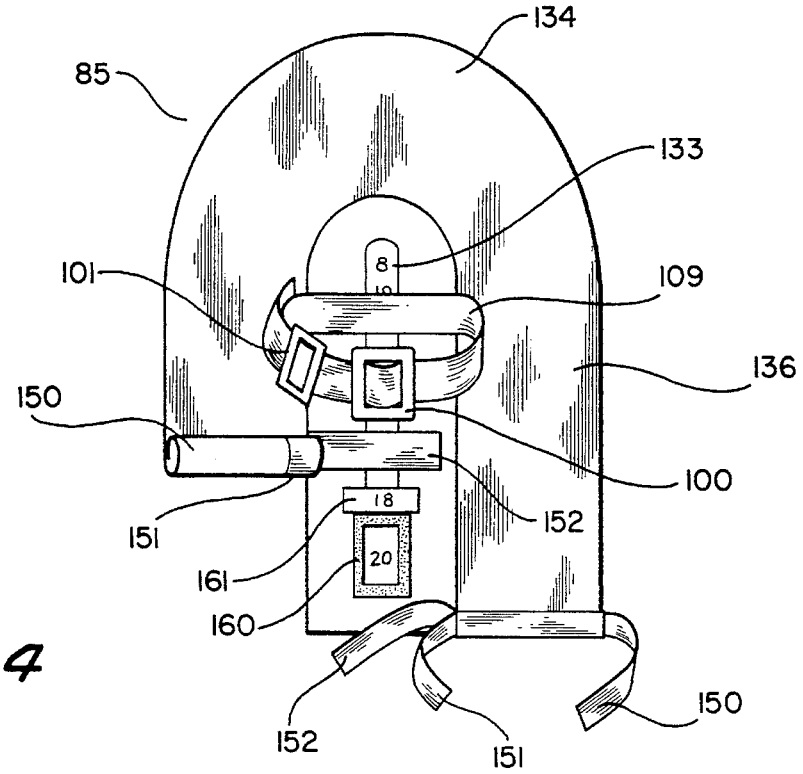
FIG. 14 is a rear view of an alternate adjustable buoyancy compensator.

FIG. 14 depicts another retaining system for reducing the volume of adjustable buoyancy compensator 85. Double sided hook strap 151 and double sided loop strap 150 are used to lock off the reduced portion of the buoyancy compensator chamber 85. Double sided hook flap 152 attaches the rolled up chamber securely to the loop covered body of the BC 85. The reducible portion of the BC chamber is indicated as 136. The portion of the BC 85 that supports the neck and head is indicated as 134. The keel weight 100 is threaded on tank band 109, that is secured to the air cylinder by cam buckle 101. The hook flap 161 seals off the lead shot filled pouch 160 used to neutralize the inherent buoyancy of the bc.

OPERATION OF THE INVENTION

In FIG. 1 the water enthusiast is shown wearing a traditionally designed vest 203 which could be used in any recreational water sport. The vest 203 contains a multi-function rescue product and raft 207 within its rear pocket. If the ocean kayaker should become separated from his kayak at sea the victim 201 could pull on lanyard 211 and remove the rescue product and begin inflating it. A releasable attachment cord 212 will keep the rescue product from blowing or washing away. Because the vest 203 includes quick release coupler 91, the vest can also eventually be used as a forward chamber with the appropriate dedicated buoyancy compensator if the user becomes certified in diving.

FIG. 2 shows that the diver 202 wearing a current vest style buoyancy compensator 204, can adapt the rescue product 207 contained in pocket 210 to be carried between the diver and the tank by use of a strap 23 which passes through the arm holes of the buoyancy compensator. Access and use of the rescue product 207 is the same as described in FIG. 6 below.

FIG. 3 shows the victim 201, of a common carrier accident wearing a traditionally designed inflatable vest 205, modified with pocket 213 which contains a single use multi-function rescue product and raft 207 constructed from a mylar film and vacuum packed much as a single use raincoat. After surviving the initial entry the product is inflated and used as a life ring, then rescue board or distress marker, and finally inflated to a raft if necessary to remove the victim from the hypothermic effects of the water.

FIG. 4 shows the airline or ferry safety seat cushion 206 containing the multi-function rescue product and raft 207. The victims arms are placed through straps 15. The cushion 206 provides minimal safety in the water. The incorporated rescue product 207 would confer dramatic improvements in survival at sea.

Referring to FIG. 5, as the user exhales through oral inflator 16 the air passes into manifold 17 that connects multiple chambers to the oral inflator 16. The air is directed to the appropriate chamber according to the diameter of the tubing indicated as 20, 30, 40, 50 and 60. The one way check valves 19, 29, 39, 49 and 59 create structural integrity for each of the chambers down stream. If a puncture should occur only that chamber will loose pressure. If the oral inflator fails, the manifold 17 at its barbed connectors 18 can be disconnected from connector tubes 22 allowing separate inflation through each check valve. The simplicity of a single oral inflator will help the victim focus on a single task. Obviously, separate oral inflators could be used and the significance of which oral inflator is to be inflated first could be printed on the raft in multiple languages.

FIG. 6 is a top view of the multi-function rescue product and raft 207, fully inflated. The life ring 21 because of its small diameter is inflated first and quickly because of its low volume. This life ring could be used by the individual or extended to a family member. The floor chambers 31 and 41 would be inflated next also because they are low volume, once inflated the first three chambers forms a float that gives the victim a sense of accomplishment. Inflated chambers 21, 31 and 41 create a four foot rescue board for approaching a flailing, distressed victim. The float can also be held aloft as a high visibility distress marker signalling other victims or search and rescue efforts. The inflated floor also gives a platform for the victim to rest on. If necessary the victim can rest on the first three chambers as they begin inflating the high volume side wall tubes 51. Once inside the raft the infrared reflective mylar would help to offset further loss of body temperature. Finally the canopy arch 61 is inflated and the victim creates an enclosed space, that is highly visible to the naked eye as well as radar. The multiplicity of chambers confers protection from puncture.

FIG. 7 is a view of the inflated raft 207 in cross section. The sequence of inflation, 21, 31, 41, 51, then 61 shows how the life ring would convert to a rescue float and ultimately to a raft.

FIG. 8 shows the scuba diver 202 holding a 100 psi pressure hose 191 with its common female quick release coupler 91, disconnected from the male quick release coupler 192 of the power inflator 87. The common female coupler 91 can be attached to any of the other incorporated chambers such as the horse collar vest which is deflated and stored in the shoulder straps indicated at 80, or any of a multiplicity of deflated chambers that can be interchangeably stored in waist band as indicated at 90 or in the pocket. The high pressure hose 191 is employed to effect a more rapid inflation in an emergency. For routine operation of the chambers stored in the waist band or shoulder straps, they are in fluid communication with the buoyancy compensator chamber 85 through quick release couplers 91 and check valves 92. The crotch strap 94 is the only way the user can be assured that he will not be separated from his inflatable rescue product in heavy surf. With the auxiliary chambers deflated and stored the diver has a sleek profile with reduced hydrodynamic drag while swimming under water. Most importantly with the high lift surface flotation chamber stored it will not contribute its buoyancy to the total lift available to the diver under water.

FIG. 9 Shows a diver 202 with redundant separating shoulder mounted horse collar 80 inflated. The diver also is demonstrating the self rupturing emergency ascent chamber 180 inflated at the diver's waist. It is to be noted that the dedicated adjustable buoyancy compensator 85 has been reduced by rolling up the lower portion of the chamber as indicated at 130. If this reduced chamber was providing insufficient lift at a depth and the diver choose to attempt an emergency buoyant ascent the forward chamber 180 at the waist could be released. If the diver was out of air, the air pressure in the rear chamber would spill forward causing chamber 180 to inflate. Alternatively, chamber 180 can be inflated from its own compressed cylinder 215 when chamber 180 is disconnected at quick release coupling 91 or if air cylinder 102 and buoyancy compensator 85 are both empty. If the emergency ascent was uncontrolled, and the diver forgot to deflate chamber 180 it would self destruct at rupture plug 182, releasing its entrapped air that had become pressurized because of the ascent. At that point the ascent rate would slow allowing the diver to regain control further slowing his ascent rate to within the recommended rate of 40 to 60 feet per minute, rather than the ascent rates of 200 to 300 feet per minute, generated during and emergency buoyant ascent. If the diver should snag a fish hook in their primary chamber 85, then the horse collar vest stored in the shoulder straps would provide a redundant personal safety vest. In the event that the diver needed to ditch the dive gear, the power inflated forward horse collar safety vest can be quickly disconnected by quick release coupling 91. Alternatively the horse collar can be separated and extended to the divers buddy who has suffered a failure of his single chambered buoyancy compensator. If the diver was snorkeling the horse collar safety vest could be disconnected and inflated via oral inflator 84 and used independently from the remainder of the heads up safety vest.

FIG. 10 shows a diver 202 with flap 106 which was used to enclose the flotation chamber 97 now shown in the open position. In front of flap 106 is the separating horse collar forward surface flotation chamber 97, inflated at the divers waist. The forward chamber is retained by elastic webbing 104 that allows the chamber to expand away from the diver rather than constrict the divers abdomen and therefore breathing. Quick release buckle 104 allows the diver to separate the forward bladder which can then be disconnected via quick release coupler 91. Once the flotation chamber 97 is free it can be used as a rescue float for approaching a hypoxic diver, held aloft as a distress marker, left floating at the surface to warn boat traffic of diver activity, used under water as a bottom marker in search and rescue activities or used as a small salvage device. For rapid emergency inflation the product can be stored in a pocket and connected to the 100 psi air hose. Chamber 97 as it is currently shown is retained by strap 104 providing the central point of buoyancy that contributes to the heads up surface position. The diver is also shown with quick release shoulder trim weights 174, retained by hook and loop fastener 173 and 175. The diver by pulling on D-Ring 172 peels open the pocket and lead shot filled container 174 can fall away from the diver. The trim weights are exactly opposite the site of underwater buoyancy contained in the buoyancy compensator and helps the diver achieve an ideal balanced underwater surface position. The diver 202 is also shown carrying an alternate forward or flotation chamber 96 which can be substituted for chamber 97 and secured to the driver by elastic retaining strap 104 which passes through strap eyelets 110 mounted on the edges of bladder 96. This larger float has all the same functions of the horse collar forward chamber 97 with the addition that it can be used as a transport raft for a disabled diver or act as a surf mat at the end of the dive for swimming back to shore.

FIG. 12 illustrates a composite of several of the disclosed inventions. The multi-chambered heads up safety vest modified for use by the scuba diver by inclusion of tank bands 109 which attach the tank 102 to a fully inflated adjustable buoyancy compensator 85. The tank bands 109 are longer than those currently located on buoyancy compensators in the market place. The extra length in tank band 109 is needed to allow the diver to thread on the tank compensating keel 100. The keel 100 can be located on the top, bottom or on both tank bands 109 as needed. A diver in a bathing suit needs to locate the keel 100 on the lower band. A diver wearing a buoyant thermal protective suit requiring a weight belt can shift the keel to the top tank band 109 to establish the ideal surface position. Cam buckle 101 is located off to the side of the tank 102 so that the back side of the tank is available for placement of the keel 100. Over pressure relief valve 111 is located opposite the buoyancy compensator power inflator 87 allowing the two to be interchanged. The beginner is accustomed to the power inflator 87 coming over the shoulder but when located in this position power inflator 87 floats free and is often hard to locate underwater. When the power inflator 87 is mounted on the front of the buoyancy compensator chamber 85 it hangs straight down between the diver and the tank an is easily located when needed. The multi-function rescue product and raft 207 is located between the diver 202 and the tank 102. Lanyard 211 wraps around rescue product 207 allowing the diver to remove the rescue product 207 for use without having to remove any other dive gear. A generic forward chamber 105 is inflated and, retained by elastic strap 104. The flap 106 includes a variable fabric valve comprised of hook and loop fasteners 171 that variably regulates the use of the forward chamber 105. Reducer hook strip 107 decreases the amount of interactive surface in the fabric valve allowing the diver 202 to vary the operation of the fabric valve from automatic to semi-automatic, to manual. With the reducer strip in place the air pressure from the rear chamber is capable of forcing open the valve deploying the forward chamber without the diver needing to do anything. In the semi-automatic mode the diver 202 partially removes the reducer strip 107, now the fabric valve 171 will swell because of the mounting air pressure, after a period of time flap 106 will eventually open. As the diver becomes more skilled and capable of operating the fabric valve 171 in flap 106 in the manual mode, he will totally remove the reducer strip 107. With no reducer strip 107 in place the strength of the fabric valve 171 exceeds the 2.5 psi over pressure relief valve 111 on the rear chamber or the small bore over pressure relief valve built into the oral inflator 193. On a rapid ascent from significant depths, pressure will build up at such a fast rate that the small bore oral inflator over pressure relief valve 193 cannot keep up and the forward chamber will rupture, protecting the diver from any further acceleration and will contribute to the divers deceleration by removing the buoyancy contributed by the forward chamber. With no reducer strip 107 in place the high lift surface flotation device is safely locked away while the diver is under water, reducing the amount of lift attached to the divers body that entraps air or could be inflated by panic or mechanical failure of the power inflator 87. Waist band buckle 178 is attached to hook and loop base 179 that allows the diver to quickly and reliably shift the position of the waist band buckle 178 to adapt the product to different divers or the same diver with different thermal protective gear.

FIG. 13 illustrates one way that an adjustable buoyancy compensator 85 can be assembled from the front. The body of the buoyancy compensator 85 is covered with loop fastener 131. The inside edge of the side chamber forms a flap 138 which has loop fastener 137 on the front side and hook fastener 132 on the back side. As the chamber is rolled up the hook and loop adhere along the inside edge and clip 196 locks the outer edge from unwinding under pressure from the air contained in the buoyancy compensator 85. The adjustable buoyancy compensator 85 gives the diver the ability to further reduce the amount of lift attached to his body to the absolute minimum needed for each dive profile and dive environment. Reducing unnecessary risk of rapid ascent, embolism and the bends.

FIG. 14 shows an alternate way to reduce the volume of a chamber using hook straps 151 and loop straps 150. As the chamber is rolled up to the desired amount of lift as indicated on indicator gauge 133, straps 150 and 151 are fastened. The side chambers are attached to the loop body of the buoyancy compensator by way of hook strap 152. Hook flap 161 closes loop pouch 160 that contains lead shot to neutralize the inherent buoyancy of the buoyancy compensator 85 so that ballast is not consolidated onto the weight belt. Keel weight 100 is shown on the top tank band 109. There are many ways that the chambers could be secured after being reduced in volume such as by buttons, snaps, zippers, pins, constricting bands, fabric flaps and fabric valves. The final result is that the diver can vary the volume of their buoyancy compensation chamber as required for a safe dive.

SUMMARY, RAMIFICATIONS, and SCOPE

Accordingly, it will be appreciated by those skilled in the art that the correct positioning of a very small amount of buoyancy can accomplish what five to ten times that same amount of buoyancy cannot, a single heads up righting moment that will protect the airway. After surviving the initial entry into the water, signaling search and rescue efforts can make the difference between life and death. Dual tragedy is the term applied to the death of the rescuer by a hypoxic victim, an inflatable float is one of the safest ways to approach a floundering victim. It can take hours for available life rafts to round up survivors, often victims who have survived the initial insult of entry perish within thirty minutes of hypothermia. The only solution to hypothermia is to remove the victim from the water whether they are waiting to be picked up by the life raft or if they are going to be spending and extended period at sea until land based search and rescue efforts arrive. The disclosed product is affordable, storable and simple. The multi-function rescue product and raft comprised of a multiplicity of chambers, constructed from the appropriate material, can be built into the heads up safety vest where it is safely stored until needed.

The principles of a heads up safety vest need to be modified for use under water by separating out high lift surface flotation, incorporating a variable volume buoyancy compensation chamber that can be reduced to the lowest volume necessary for a particular set of dive gear and dive environment. The current invention makes great strides in reducing the emergency ascent rate and thus reducing the exposure to pulmonary barotrauma, arterial gas embolism as well as the chances of developing decompression sickness. The buoyancy of some air cylinders when empty and the use of a primary back mounted buoyancy compensator, require the addition of a tank compensating keel to assure the diver that with or without the deployment of the forward chamber that once the diver is at the surface, that their only inflatable product will roll them over and place their airway out of the water if they are unable to do so themselves. A third self rupturing emergency buoyant ascent chamber is an option if the diver insists on using an underwater propulsion device. The incorporation of numerous rescue devices as integrated chambers in fluid communication with the power inflated dedicated buoyancy compensator, allows the user rapid access to rescue boards, distress markers, transport rafts, dive site markers, underwater markers, salvage devices, tender crafts and surf mats. This wide range of power inflatable products confers significant advances in water safety, survival and enjoyment.

I claim:

1. A safety garment for a water-borne person comprising a single garment, at least one first buoyancy chamber provided in said garment disposed on the person's back, at least one second buoyancy chamber provided in said garment disposed on the person's front side above the person's waist and positioned substantially centrally about the longitudinal axis of said person, means for inflating each of said chambers, whereby said second buoyancy chamber effectively generates a righting movement, whereby an incapacitated water borne person's mouth and nose are positioned and maintained out of the water at all times; said first and second buoyancy chambers being in regulated fluid communication with each other, whereby when said first and second buoyancy chambers are used for diving, they can be selectively inflated to provide increased buoyancy; valve means in said fluid communication between said first and second buoyancy chambers for regulating the inflation of the second buoyancy chamber from the first buoyancy chamber, and pressure release means operatively connected to said second buoyancy chamber, said pressure release means comprising a rupturable seaming disposed about said second buoyancy chamber, to thereby control the ascent velocity of the diver.

2. The garment of claim 1 wherein said at least one first buoyancy chamber is of a variable volume construction,

3. The garment of claim 2 wherein the first buoyancy chamber includes adjustable securing means to vary the volume thereof.

4. The garment of claim 3 wherein the volume of the first buoyancy chamber is reduced by rolling the chamber and securing the same in place.

5. The garment of claim 4 wherein the first buoyancy chamber is provided with strap means for rolling and securing the same to prevent the same from inflating under pressure.

6. The garment of claim 7 wherein the strap means include Velcro® for securing the same in place,

7. The garment of claim 4 wherein indicator means is provided adjacent the first buoyancy chamber for indicating to the water borne person the pounds of available lift.

8. The garment of claim 7 wherein the indicator means is a graduated scale.

9. The garment of claim 2 wherein a pouch is provided on said first buoyancy chamber and contains ballast to neutralize bouyancy of the same.

10. The garment of claim 2 wherein said first buoyancy chamber is secured to a body harness having shoulder straps and a waist band with said straps being adjustably positioned with respect to said waist band.

11. The garment of claim 10 wherein the waist band is provided with an adjustable belt buckle to accomodate different sized persons by positioning the same along the length thereof.

12. The garment of claim 1 wherein a power inflation means is associated with said first bouyancy chamber and includes at least two alternate coupling means.

13. The garment of claim 12 wherein the coupling means are disposed on either side of said first buoyancy chamber.

14. The garment of claim 1 wherein a raft is removably secured to said at least one said first bouyancy chamber.

15. The garment of claim 1 wherein a cylinder is mounted adjacent said at least one buoyancy chamber.

16. A life saving garment comprising at least one buoyant chamber adapted to be worn by the user, said chamber including a storage pocket, a separate life preserving device disposed in said pocket, means secured to said separate life preserving device to facilitate removal of said separate life preserving device from said pocket, said separate life preserving device including a plurality of separate inflatable chambers, and inflation means communicating with said separate inflatable chambers for sequentially inflating said separate inflatable chambers, said inflation means including a manifold having a plurality of outlets, each of said outlets communicating with a respective separate inflatable chamber, check valve means in each of said outlets, each of said check valve means having a pressure relief setting corresponding to a respective separate inflatable chamber to facilitate the sequential inflation of the separate inflatable chambers for inflating the separate life preserving device.

17. The garment of claim 16 wherein said removing to facilitate includes a laynard disposed about said life preserving device to facilitate complete removal of the same.

18. The garment of claim 16 wherein said outlets are of varying diameters whereby certain separate inflation chambers will be filled before others to ensure the immediate and progressive safety of the user.

19. The garment of claim 18 wherein said life preserving device includes a canopy disposed over said separate inflated chambers.

* * * * *